US008748748B2

(12) United States Patent
Shapiro

(10) Patent No.: US 8,748,748 B2
(45) Date of Patent: Jun. 10, 2014

(54) CLAMP ASSEMBLY AND CONDUCTIVE CUSHION WITH MOLDED-IN GROUNDING FOIL

(75) Inventor: Jay S. Shapiro, Ventura, CA (US)

(73) Assignee: Kirkhill-TA Co., Valencia, CA (US)

( * ) Notice: Subject to any disclaimer, the term of this patent is extended or adjusted under 35 U.S.C. 154(b) by 75 days.

(21) Appl. No.: 13/404,778

(22) Filed: Feb. 24, 2012

(65) Prior Publication Data

US 2012/0225571 A1 Sep. 6, 2012

Related U.S. Application Data

(60) Provisional application No. 61/448,138, filed on Mar. 1, 2011.

(51) Int. Cl.
*H01B 7/00* (2006.01)

(52) U.S. Cl.
USPC ..... 174/135

(58) Field of Classification Search
USPC ..... 174/51, 359, 78; 439/100
See application file for complete search history.

(56) References Cited

U.S. PATENT DOCUMENTS

| | | | | |
|---|---|---|---|---|
| 2,279,866 | A * | 4/1942 | Ellinwood | 174/40 CC |
| 2,399,899 | A | 5/1946 | Tinnerman | |
| 2,425,153 | A | 8/1947 | Harrison | |
| 4,529,257 | A * | 7/1985 | Goodman et al. | 439/271 |
| 4,659,870 | A * | 4/1987 | Jones | 174/84 S |
| 6,534,714 | B2 | 3/2003 | Daume | |
| 6,910,899 | B1 * | 6/2005 | Daume | 439/100 |
| 7,258,304 | B2 | 8/2007 | Miener | |

* cited by examiner

*Primary Examiner* — Phuong Dinh
(74) *Attorney, Agent, or Firm* — Perkins Coie LLP

(57) ABSTRACT

Systems and methods for securing and electrically grounding objects or payloads are provided herein. Clamp assemblies and the manufacture of clamp assemblies in accordance with the present technology can provide reliable and redundant electrical grounding and secure cushioned fastening. In one embodiment, an electrically grounding cushioned clamp assembly includes an elastomer cushion with a longitudinal opening extending therethrough. The clamp assembly can include an engaging surface configured to engage a payload and an electrically conductive comb strip disposed at least partially in the longitudinal opening. Portions of the comb strip can be exposed adjacent to the engaging surface to contact the payload and provide a plurality of electrical grounding paths.

20 Claims, 4 Drawing Sheets

CLAMP ASSEMBLY AND CONDUCTIVE CUSHION WITH MOLDED-IN GROUNDING FOIL

CROSS REFERENCE TO RELATED APPLICATIONS

This application relates to and claims the benefit of U.S. Provisional Patent Application No. 61/448,138 filed Mar. 1, 2011, and titled CLAMP ASSEMBLY AND CONDUCTIVE CUSHION WITH MOLDED-IN GROUNDING FOIL, which is incorporated herein by reference in its entirety.

TECHNICAL FIELD

The following disclosure relates generally to devices, systems and methods of manufacture for cushioned clamps that secure an object or payload to a separate structure while electrically grounding the payload to the separate structure.

BACKGROUND

Various types of cushioned clamps are known in the art for securing objects or payloads to separate structures. Additionally, cushioned clamps that electrically ground the payload to the separate structure have also been utilized. However, many of the designs that have been implemented suffer from drawbacks. These drawbacks include labor intensive manufacturing, assembly and installation, and parts that may be susceptible to less optimal performance over time. Accordingly, it is desirable to provide a design for a conductive cushioned clamp assembly that does not suffer from these problems.

SUMMARY

Aspects of embodiments in accordance with the present disclosure overcome drawbacks experienced in the prior art and provide other benefits. At least one embodiment provides an electrically grounding cushioned clamp assembly for clamping a payload. The assembly can include a cushion member with a longitudinal opening extending therethrough. The cushion can also include an engaging surface configured to engage a payload. An electrically conductive comb strip can be disposed at least partially in the longitudinal opening, with portions of the comb strip being exposed adjacent to the engaging surface to contact the payload and provide a plurality of electrical grounding paths.

A method for making an electrically grounding cushion assembly can include bending metal teeth of a metal comb strip to an angle of approximately 90 degrees from a connecting strip of the metal comb strip. The metal teeth can be inserted into an elastomer cushion strip and bent an additional 90 degrees until they are flush with the cushion strip. The elastomer cushion strip can be molded with another elastomer cushion strip into a cushion assembly.

In one embodiment, an electrically grounding cushioned clamp assembly for securing a payload can include a cushion assembly and an electrically conductive strap. The strap produces the final shape of the cushion assembly and provides the structural strength of the clamp assembly. The cushion assembly can include a cushion member having an opening extending adjacent to a longitudinal axis and a metal comb strip bonded to the cushion member. The metal comb strip can be configured to engage both the payload and an electrically conductive strap can be disposed in the opening of the cushion member in engagement with the metal comb strip. This engagement can establish an electrical connection from the strap to the metal comb strip. Additionally, the strap can be configured to receive a fastener to secure the payload.

DETAILED DESCRIPTION

The present disclosure is directed generally to devices, systems and methods of manufacture for cushioned clamps that secure and electrically ground an object or payload to a mounting structure. For example, a cushioned, grounded saddle clamp assembly configured in accordance with one embodiment of the disclosure includes a conductive metal comb strip firmly molded and/or bonded to an elastomer cushion of the clamp. A connecting strip on the comb can provide an electrical connection to an electrically conductive strap or band, such as a metal strap or band. Multiple teeth on the comb are exposed through the elastomer cushion and can provide multiple independent electrical connections to the payload. As described in greater detail below, these multiple independent electrical connections can provide redundant grounding paths that enable a more reliable grounding of the payload to the structure through the metal comb strip and the metal strap or band. Additionally, the connecting strip and the teeth of the conductive metal comb strip can be molded flush with the elastomer cushion and the conductive metal comb strip can be bent into a selected shape, such as a generally "U" shape or other selected shape, and part of the elastomer cushion being positioned between the connecting strip and the teeth of the comb. In this manner, the comb is held firmly in place. Such a configuration aids in preventing the conductive metal comb strip from being dislodged from the assembly by either the payload "snagging" the teeth, or the metal band "snagging" the connecting strip.

Figure 1:
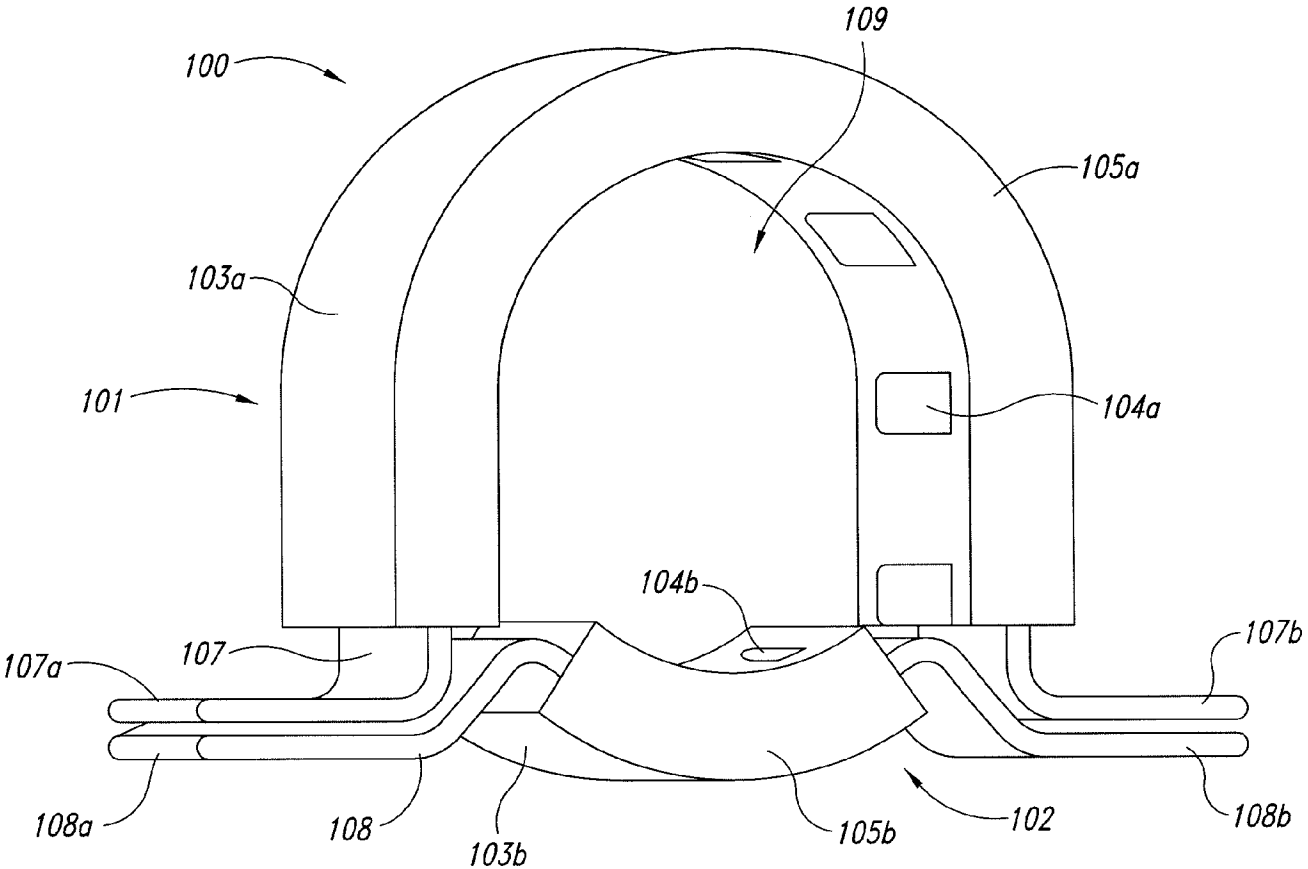
FIG. 1 is an isometric view of a cushioned, grounded saddle clamp assembly configured in accordance with an embodiment of the disclosure.
Figure 2:
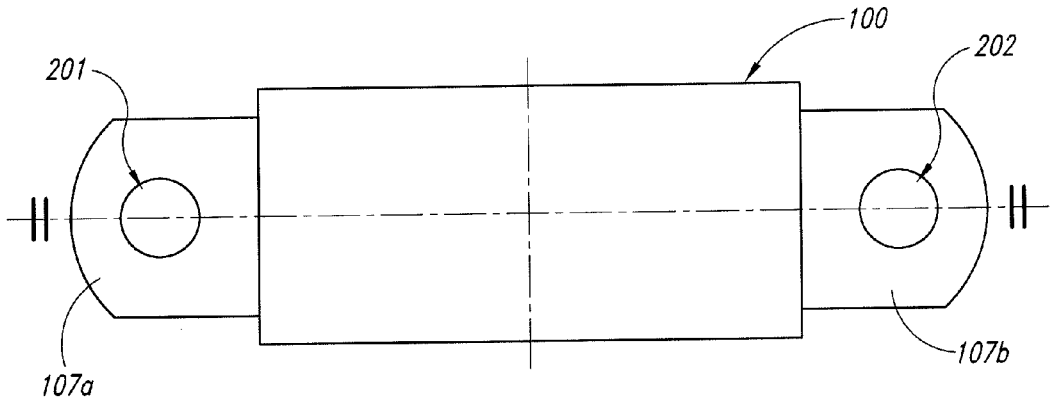
FIG. 2 is a top view of the saddle clamp assembly shown in FIG. 1.
Figure 3:
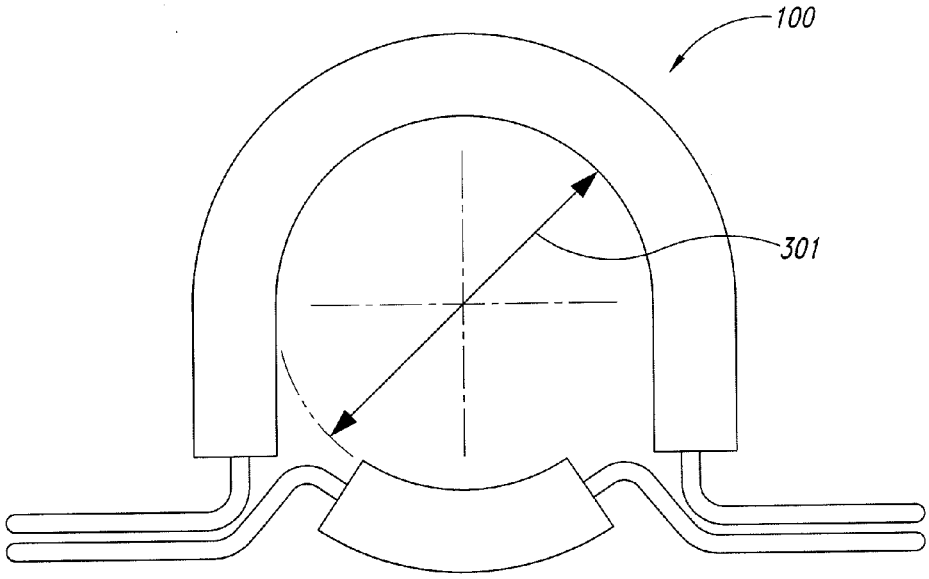
FIG. 3 is a front view of the saddle clamp assembly shown in FIG. 2.

Although the assembly of FIGS. 1-3 shows a cushioned, grounded saddle clamp assembly, those skilled in the art will recognize that the cushioned, grounded clamp assembly described herein could be configured in many different arrangements and embodiments. For example, the clamp assembly could be shaped in a loop where a single cushion assembly and metal band wrap fully around a portion of the payload to be secured, with a single fastener inserted through the openings in each end of the clamp assembly to secure the payload. In such an embodiment, a saddle portion of the assembly would not be necessary. Other examples include, but are not limited to, rectangular Loop Clamps, Double Mount style clamps (similar to FIG. 1 but with a flat bottom piece (102)) and hinged-style clamps. Additionally, further variations of the present disclosure may be utilized without deviating from the spirit and scope of the invention. Furthermore, the various embodiments set forth below have been described with a level of detail to provide a thorough understanding of the disclosure. However, other structures and systems often associated with clamp assemblies may not have been fully discussed to enable a clearer presentation of embodiments of this disclosure.

FIG. 1 is an isometric view of a cushioned, grounded saddle clamp assembly 100 in accordance with at least one embodiment. In the illustrated embodiment, the clamp assembly 100 includes an upper portion 101 and a lower portion 102. The upper portion 101 and the lower portion 102 each have cushion assemblies 103*a* and 103*b* that include conductive metal comb strips 104*a* and 104*b* molded into portions of elastomer cushions 105*a* and 105*b*, respectively. The upper portion and lower portions 101 and 102 each have an internal conductive member 107 and 108 that extend through the cushion assemblies 103*a* and 103*b*, respectively. The internal conductive members 107 and 108 can be metal, such as strips of metal forming a band or strap. The internal conductive members 107 and 108 have end portions 107*a* and 107*b*, and 108*a* and 108*b* that project axially beyond the ends of the elastomer cushions 105*a* and 105*b*, so the ends are uncovered and at least partially exposed. The upper and lower portions 101 and 102 are shaped so that when placed together they form an opening 109 and end portions 107*a* and 108*a*, and 107*b* and 108*b* of the internal conductive members 107 and 108 align with each other and can be in engagement with each other.

Although a payload is not shown in FIG. 1, those of ordinary skill in the art will appreciate that the clamp assembly 100 can be positioned where the opening 109 contains a payload, or a portion of a payload, that is to be secured.

FIG. 2 is a top view of the clamp assembly 100 shown in FIG. 1 and illustrating further aspects of the particular embodiment. End portions 107*a* and 107*b* are visible in the illustrated embodiment with openings 201 and 202 shown extending through the aligned end portions 107*a*, 108*a*, and 107*b*, 108*b*, respectively. Fasteners (not shown), such as bolts, screws, etc., can be used to secure the clamp assembly 100 to the mounting structure (not shown). The fasteners pass through the openings 201 and 202 and hold the end portions 107*a* and 108*a*, and 107*b* and 108*b* firmly together with end portions 108*a* and 108*b* pressed firmly against and normally establishing electrical contact with the mounting structure. Additionally, as will be further described below, the tightening of the fasteners compresses the cushion assemblies 103 against the payload being clamped, thereby ensuring electrical contact is established and maintained between the metal comb strips 104 with the payload and with the internal conductive members 107 and 108. Although a separate structure to which a payload is to be secured is not shown in FIG. 1 or 2, those skilled in the art will appreciate that the clamp assembly 100 can be used to secure a payload to any suitable mounting structure. For example, the clamp assembly 100 could be used to secure a payload (e.g., a cable, wire bundle, conduit, fuel line, fluid line, or other payload) to an aircraft structure, such as a fuselage or wing.

FIG. 3 is a front view of the saddle clamp assembly shown in FIG. 2. A diameter 301 of the clamp assembly 100 is shown. This diameter roughly corresponds to the diameter of a cylindrical payload to be secured by the clamp assembly 100.

Figure 4:
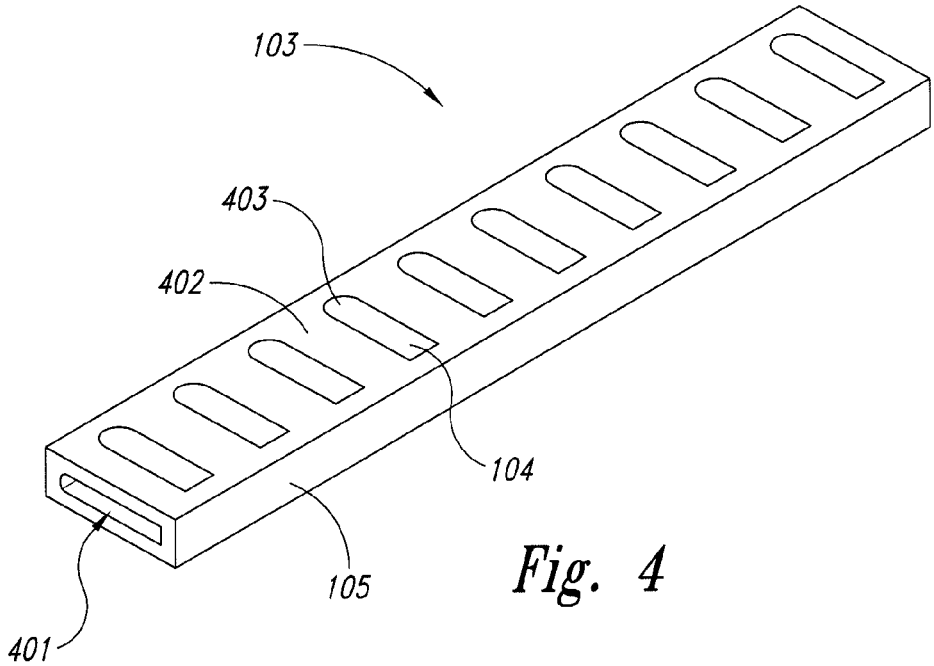
FIG. 4 is an isometric view of a cushion assembly configured in accordance with an embodiment of the disclosure prior to assembly with the strap.
Figure 5:
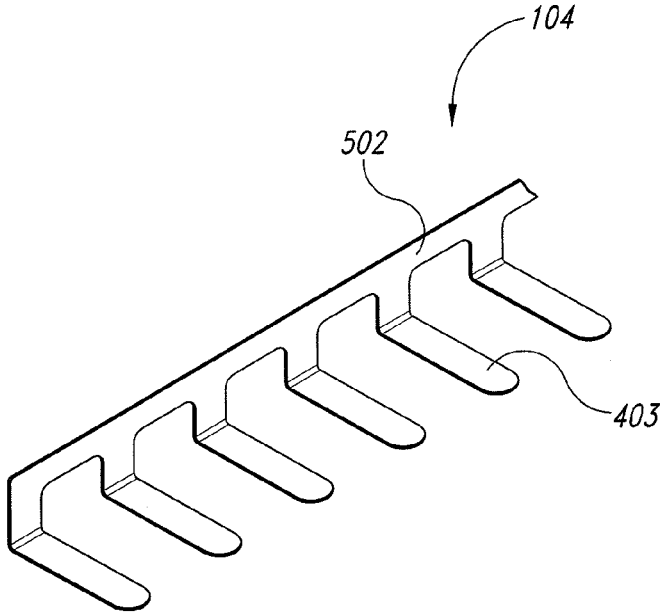
FIG. 5 is an isometric view of a bent conductive metal comb strip, prior to installation, in accordance with an embodiment of the disclosure.

FIGS. 4-7 illustrate further features of a cushion assembly 103 configured in accordance with an embodiment of the present disclosure. FIG. 4 is an isometric view of the cushion assembly 103 that has the molded elastomer cushion 105 with an internal cavity 401 that extends through the elastomer cushion 105 along a longitudinal axis. The internal cavity is shaped and sized to snugly receive and bend as needed to match the shape of the internal conductive member 107/108. The metal comb strip 104 is molded into the elastomer cushion 105, such that a portion of the metal comb strip is electrically exposed within the internal cavity 401. The metal comb strip 104 has a plurality of teeth 403 spaced apart from the internal cavity 401 and are substantially flush with an exterior surface 402 of the elastomer cushion 105. FIG. 5 shows the bent metal comb strip 104 prior to insertion into the elastomer cushion 105 during a manufacturing process. The multiple teeth 403 of the metal comb strip 104 are integrally and electrically connected together by a connecting strip 502. The connecting strip 502 is positioned within the elastomer cushion 105 and the portion positioned inside cavity 401 is electrically exposed so as to engage the internal conductive member 107/108 extending through the internal cavity 401.

Figure 6:
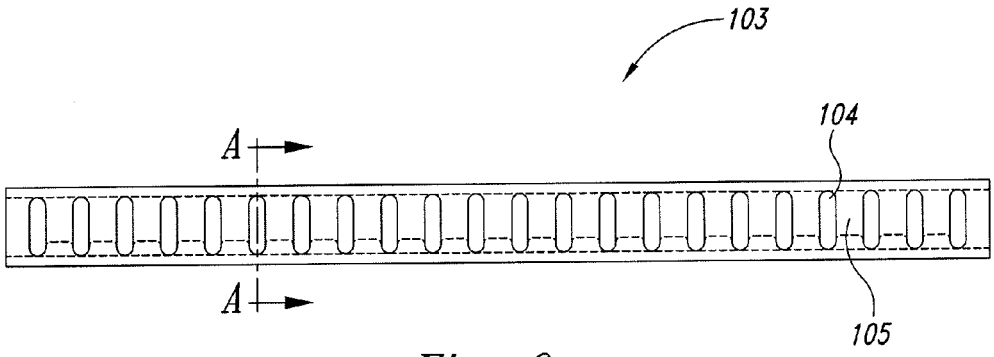
FIG. 6 is a top view of the cushion assembly shown in FIG. 4.
Figure 7:
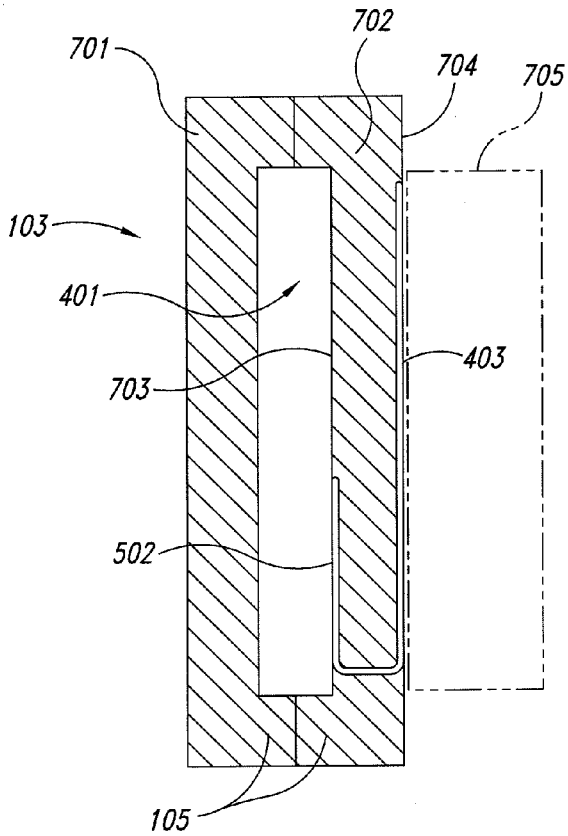
FIG. 7 is a cross sectional view from point A to A of the cushion assembly shown in FIG. 6 in accordance with an embodiment of the disclosure.

FIG. 6 is a top view of the cushion assembly 103 of FIG. 4. This view shows a line A-A, along which a cross sectional view of the cushion assembly 103 is shown in FIG. 7. The illustrated elastomer cushion assembly 103 includes an upper cushion strip 701 molded together with a lower cushion strip 702 to form a box-shaped elastomer cushion 105 with a substantially fully enclosed internal cavity 401. The lower cushion strip 702 has an interior surface 703 that engages the internal conductive member 107 (shown in phantom limes), and that supports the connecting strip 502 of the metal comb strip 104. The lower cushion strip 702 also has an exterior engaging surface 704 facing away from the interior cavity 104 and that supports the teeth 403 of the metal comb strip 104 in position to engage a cylindrical payload extending through the opening 109 of the clamp assembly (FIG. 1).

Figure 8:
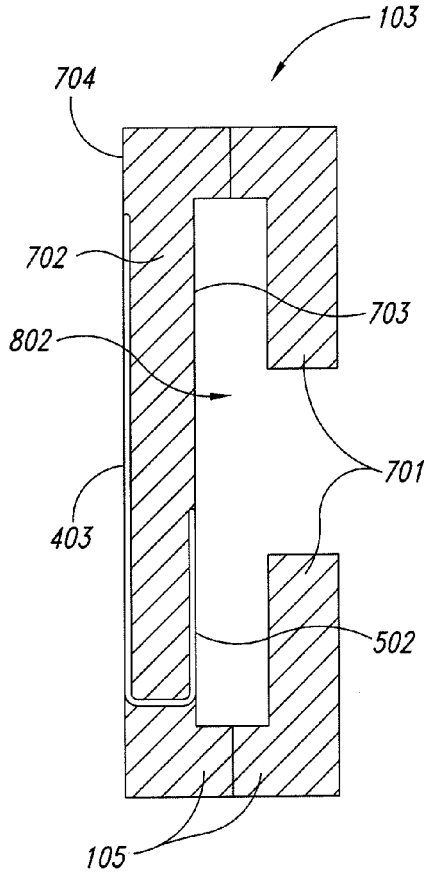
FIG. 8 is a cross sectional view of a clip strap style cushion assembly configured in accordance with another embodiment of the present disclosure.

FIG. 8 is a cross sectional view of a cushion assembly 103 for a clip strap style cushion assembly in accordance with an alternate embodiment. This alternate embodiment is similar to the embodiment of FIGS. 4-7 except that the upper elastomer cushion strip 701 is a two-part component. Rather than a fully enclosed internal cavity 401, the illustrated alternate embodiment has an internal cavity formed by an open channel 802 that extends the length of the cushion assembly 103. This open channel allows the cushion assembly 103 to be clipped onto the internal conductive member 107/108, such as a metal strap, rather than requiring the metal strap to be fed or pushed axially through the fully enclosed internal cavity in the cushion assembly of FIG. 7.

An elastomer cushion assembly 103 configured in accordance with an embodiment of this disclosure may be manufactured by bending the metal comb strips at a selected angle, as shown in FIG. 5. The metal teeth 403 are inserted into apertures in the lower cushion strip 702 until the connecting strip 502 and the adjoining teeth portions are flush with the interior surface 703 of the lower cushion strip 702. In one embodiment, the metal teeth 403 extend through perforations in the lower cushion strip 702. The perforations can be created by a perforating/installation structure used during manufacturing or the perforations can be otherwise formed into the elastomer cushion prior to assembly of the cushion assembly.

After the metal teeth 403 are inserted in the lower cushion strip 702, the teeth 403 can be bent until they are flush with the engaging surface 704 of the cushion strip 702. The lower cushion strip 702 with the metal comb strip 104 installed is then placed into a cushion mold with the upper elastomer cushion strip 701 and molded together and heat cured to form the box shaped cushion assembly 103. During this molding process, the teeth 403 of the metal comb strip 104 can be partially recessed in the lower elastomer cushion strip 702. Accordingly, the surface of the recessed teeth can be flush or coplanar with the engaging surface 704 of the lower elastomer cushion strip 702. The metal comb strip 104 is integrally molded with the elastomer cushion in the resulting cushion assembly 103 with a portion of the elastomer cushion positioned between the teeth 403 and the connecting strip 502. In one embodiment, a primer can be applied to the inside surface of the metal comb strip 104 before the components are joined together and placed in the mold. The primer assures a strong bond between the metal strip and the elastomer in the molding process. The metal comb strip 104, thus, can be molded and bonded to the lower elastomer cushion strip 702 with the exposed surfaces of the metal comb strip 104 flush with the interior surface 703 and the engaging surface 704, as shown in FIGS. 7 and 8.

The metal comb strips 104 of the present disclosure may be made of an electrically conductive, sufficiently durable foil, or other very thin metal strips. This provides for enhanced flexibility of the resultant cushion assemblies 103, which allows the cushion assemblies 103 to be used in clamp assemblies 100 having a relatively small opening 109 (i.e., a small diameter). For example, clamp assemblies 100 may be constructed to electrically ground and securely fasten payloads having diameters of approximately 4.76 mm (3/16 in.) or larger. During the manufacturing of a cushion assembly 103, the metal teeth 403 of the metal comb strips 104 can be pushed through the lower elastomer cushion strip 702 by a machine that supports the bendable thin metal teeth 403. This machine pre-punctures the raw rubber and prevents the relatively thin metal teeth 403 from bending or buckling when they are pushed through the lower elastomer cushion strip 702.

As discussed above, the metal comb strips 104 can be held in place both adhesively, via the molding and bonding process, and mechanically, via the U-shape of the installed metal comb strip 104. However, the metal comb strips 104 may also be treated with primer to further enhance bonding with the elastomer cushions 105 of the clamp assembly 100. This process strengthens the adhesion of the metal comb strips 104 to the elastomer cushions 105 and further aids in preventing the metal comb strips 104 from becoming dislodged during insertion of the internal conductive members 107 and 108, or from wear during vibration or movement of the payload.

Referring to FIGS. 1 and 7, together, the clamp assembly 100 can be fitted to a cylindrical payload and secured to the mounting structure with fasteners (not shown). The internal conductive members 107 and 108 compress the cushion assemblies 103, pressing the internal conductive members 107 and 108 against the connecting strips 502 of their respective conductive metal comb strips 104*a* and 104*b*, and establishing an electrical connection between the internal conductive members 107 and 108 and the conductive metal comb strips 104. Additionally, the compression causes the engaging surface 704 and the multiple teeth 403 of the metal comb strips 104 to be pressed tightly against the payload. Each of the metal teeth 403 on the conductive metal comb strips 104 provides an independent electrical connection between the payload and the conductive metal comb strips 104. In this manner, a redundant, reliable electrical grounding path is established between the internal conductive members 107 and 108 and the cylindrical payload. Additionally, end portions 107*a* and 107*b* are brought into contact with end portions 108*a* and 108*b* and end portions 108*a* and 108*b* are brought into contact with the mounting structure. This completes the multiple electrical grounding paths from the payload to the mounting structure. Furthermore, when an electrically conductive fastener is used, additional grounding paths may be created from the internal conductive members 107 and 108, through the fasteners to the mounting structure.

In a further advantage of the present disclosure, the metal comb strips 104 of the clamp assembly 100 provide a flush cushioned fit for the payload. As discussed above, the metal teeth 403 of the metal comb strip 104 can be flush with the engaging surface 704 of the lower elastomer cushion strip 702. Accordingly, the metal teeth 403 can provide electrical contact to the payload, and not create a gap between the payload and any part of the cushion assembly 103. As discussed above, this flush cushioned fit prevents the metal comb strips 104 from being "snagged," dislodged or damaged by the payload. Additionally, this flush fit prevents the metal comb strips from abrading or damaging the payload with any exposed edges. This lack of wear between the clamp assembly 100 and the payload is an improvement that prevents damage to the clamp assembly 100 and the payload, and ensures that the electrical connection between the payload and the mounting structure is maintained.

In yet another advantage of the present disclosure, the flexible nature of the cushion assemblies 103 and the flush fit of the connecting strip 502 allow for easy assembly of the clamp assembly 100. The internal conductive members 107 and 108 can easily be pushed through the flexible cushion assembly without "snagging" the connecting strip 502. This significantly reduces the cost and labor involved in assembling grounded clamp assemblies. Additionally, the cushion assemblies can be manufactured in standard molds to match the dimensions of existing standard cushions.

Although the clamp assembly 100 (FIG. 3) has been shown with metal comb strips 104*a* and 104*b* in upper portion 101 and lower portion 102, respectively, those skilled in the art will appreciate that the upper portion 101 or the lower portion 102 could be constructed without a metal comb strip 104*a* or 104*b*. In such an embodiment, the grounding path would be through the other cushion assembly that would retain a metal comb strip 104*a* or 104*b*.

In another embodiment of the present invention, fuel compatible elastomers, such as nitrile butadiene, may be used to construct the elastomer cushion assemblies 103. In this embodiment, the cushioned, grounded clamp assembly 100 may be used in applications where the payload is immersed in a fuel environment. For example, this may include the use of a cushioned, grounded clamp assembly 100 to secure a fluid line that extends through a fuel tank, such as within an aircraft's wing. In at least one embodiment, the bonding process that adheres the conductive metal comb strips 104 to the elastomer cushion 105 creates a molded bond that remains intact after significant periods of time immersed in fuel. Accordingly, this configuration is especially well suited for fuel exposed environments.

The embodiments disclosed herein have been provided for the purposes of illustration and description. Those skilled in the art will recognize that several variations of the above embodiments may be made without deviating from the spirit and scope of the present invention. These variations can include but are not limited to Rectangular Loop Clamps, Double Mount style clamps (similar to FIG. 1 with a flat bottom piece (102)) and Hinged-style clamps. Accordingly, the present disclosure is not intended to be exhaustive or to limit the invention to the exact embodiments disclosed herein.

I claim:

1. An electrically grounding cushioned clamp assembly for clamping a payload and being attachable to an electrically conductive clamp strap, the assembly comprising:

a cushion member with a longitudinal opening extending therethrough, the cushion member having an engaging surface configured to engage the payload; and an electrically conductive comb strip disposed at least partially in the longitudinal opening of the cushion member, portions of the electrically conductive comb strip being exposed adjacent to the engaging surface to contact the payload and provide a plurality of electrical grounding paths to the payload, wherein the electrically grounding cushioned clamp assembly is configured to removably receive the clamp strap within the longitudinal opening of the cushion member with the electrically conductive comb strip engaging the clamp strap.

2. The clamp assembly of claim 1 wherein the electrically conductive comb strip includes multiple spaced apart teeth exposed adjacent to the engaging surface.

3. The clamp assembly of claim 1 wherein the electrically conductive comb strip is a metal comb strip with a plurality of conductive teeth.

4. The clamp assembly of claim 1 wherein the cushion member is molded from at least two strips of elastomer.

5. The clamp assembly of claim 1, further comprising a internal conductive member, wherein the opening comprises an open channel, and wherein the clamp assembly is configured to clip onto the internal conductive member with the metal strap disposed within the open channel and in conductive engagement with the electrically conductive comb strip.

6. The clamp assembly of claim 1 wherein the electrically conductive comb strip is bent into a U-shape and extends along a majority of the cushion member, and wherein a portion of the cushion member is positioned within the U-shape of the electrically conductive comb strip.

7. An electrically grounding cushioned clamp assembly for clamping a payload, the assembly comprising:

a cushion member with a longitudinal opening extending therethrough, the cushion member having an engaging surface configured to engage the payload; and an electrically conductive comb strip disposed at least partially in the longitudinal opening of the cushion member, portions of the electrically conductive comb strip being exposed adjacent to the engaging surface to contact the payload and provide a plurality of electrical grounding paths to the payload, wherein the electrically conductive comb strip includes exposed external surfaces, and wherein the exposed external surfaces are substantially flush with surfaces of the cushion member.

8. The clamp assembly of claim 1 wherein the electrically conductive comb strip is molded into the cushion member.

9. A method for making an electrically grounding cushion assembly comprising the steps of:

bending metal teeth of a metal comb strip to an angle from a connecting strip of the metal comb strip;

inserting the metal teeth into a non-vulcanized elastomer cushion strip;

bending the metal teeth until they are flush with the elastomer cushion strip;

placing the elastomer cushion strip with the comb strip in a mold with at least one additional elastomer cushion strip; and molding the cushion strips into a cushion assembly.

10. The method of claim 9 wherein molding the cushion strips includes creating an opening along a longitudinal axis of the cushion assembly.

11. The method of claim 10, further comprising inserting a metal strap into the opening to form an electrically grounding cushioned clamp assembly.

12. The method of claim 9, further comprising applying a primer to the metal comb strip and bonding the metal comb strip to the first elastomer cushion strip.

13. The method of claim 9 wherein inserting the metal teeth includes supporting the metal teeth during insertion.

14. The method of claim 9, further comprising perforating the elastomer cushion strip.

15. An electrically grounding cushioned clamp assembly for securing a payload, the clamp assembly comprising:

a cushion assembly, the cushion assembly including:

a cushion member having an opening extending adjacent to a longitudinal axis, the cushion member having an exterior surface that engages the payload, and a metal comb strip bonded to the cushion member and configured to electrically conductively engage the payload; and an electrically conductive strap disposed in the opening of the cushion member and in engagement with the metal comb strip to establish an electrical connection to the metal comb strip, wherein the strap is separable from the cushion assembly and is configured to receive a fastener to secure the payload and clamp assembly.

16. The clamp assembly of claim 15 wherein the metal comb strip is U-shaped and includes a connecting strip and multiple spaced apart teeth, and wherein a portion of the cushion member is positioned between the connecting strip and the teeth.

17. The clamp assembly of claim 16 wherein the metal comb strip includes exposed external surfaces, the exposed external surfaces being substantially flush with the exterior surface of the cushion member.

18. The clamp assembly of claim 15 wherein the metal comb strip comprises a metal foil.

19. The clamp assembly of claim 18 wherein the metal foil includes a plurality of teeth, and wherein the cushion assembly includes perforations configured to close around the metal foil with substantially no gap between the metal foil and the cushion member.

20. The clamp assembly of claim 15 wherein the cushion assembly is a first cushion assembly and the electrically conductive strap is a first strap, the clamp assembly further comprising:

a second cushion assembly; and a second electrically conductive strap, wherein the first and second straps and the first and second cushion assemblies are configured to be clamped around a portion of the payload.

* * * * *